United States Patent [19]

Beasley et al.

[11] 4,239,271

[45] Dec. 16, 1980

[54] LOOP FOR FLEXIBLE STRAP

[75] Inventors: Delbert E. Beasley, Tampa; Francis E. Jones, Riverview, both of Fla.

[73] Assignee: Banks Wire Rope Slings, Inc., Tampa, Fla.

[21] Appl. No.: 963,820

[22] Filed: Nov. 27, 1978

[51] Int. Cl.[3] ..... B66C 1/18

[52] U.S. Cl. ..... 294/74

[58] Field of Search ..... 294/74; 57/139, 140 R, 57/140 BY, 151, 155; 139/408, 409, 411, 412, 413, 414, 415; 224/49

[56] References Cited

U.S. PATENT DOCUMENTS

| | | | |
|---|---|---|---|
| 2,903,291 | 9/1959 | Barthule | 294/74 |
| 3,079,192 | 2/1963 | Otley | 294/74 |

*Primary Examiner*—James B. Marbert

*Attorney, Agent, or Firm*—Stein & Frijouf

[57] ABSTRACT

An improved loop for a flexible strap is disclosed wherein the loop is reversible and protected from wear by a protective cover. First means secures the terminal end of the flexible strap to an adjacent area creating the loop. The strap is folded within the loop, creating a folded region of increased strap thickness and decreased strap width. The protective cover completely encompasses the folded region of the flexible strap. A twist is interposed in the loop enabling alternate sides of the protective cover to be positioned within the loop to alternately receive the normal wear. The foregoing abstract is merely a resume of one general application, is not a complete discussion of all principles of operation or applications and is not to be construed as a limitation on the scope of the claimed subject matter.

11 Claims, 5 Drawing Figures

LOOP FOR FLEXIBLE STRAP

BACKGROUND OF THE INVENTION

1. Field of the Invention

This invention relates to handling by hand and hoist line implements and more particularly to hoist-line slings.

2. Description of the Prior Art

Various types of straps and slings have been devised in the prior art for accomplishing various lifting and towing tasks. Traditionally, steel cable or wire rope was the primary material utilized for straps and slings. Loops at the terminal ends of the steel cable or wire rope were generally fabricated by cable fittings or the like. In recent years, nylon straps have been found to be a suitable replacement for various tasks previously accomplished by steel cables or ropes. Loops at the terminal ends of nylon straps are generally accomplished by sewing the straps with heavy nylon thread with the aid of a heavy duty sewing machines.

U.S. Pat. No. 4,052,095 illustrates a nylon sling having a loop formed therein with a partial protective cover for the loop. Unfortunately, after the protective cover has suffered excessive wear, the loop cannot be twisted to utilize an alternate protective surface.

Therefore it is an object of this invention to provide an apparatus which overcomes the aforementioned inadequacies of the prior art devices and provides an improvement which is a significant contribution to the advancement of the nylon strap art.

Another object of this invention to provide a reversible protective loop for a flexible strap having a fold of the flexible strap within the loop thereby creating a folded region of increased strap thickness and decreased strap width.

Another object of this invention is to provide a reversible protective loop for a flexible strap incorporating a protective cover completely encompassing the folded region of the flexible strap.

Another object of this invention is to provide a reversible protective loop for a flexible strap incorporating a twist interposed in the loop enabling alternate sides of the protective cover to be positioned within the loop of the strap.

Another object of this invention is to provide a reversible protective loop for a flixible strap wherein the protective cover is a plural component material having superior durability characteristics relative to the flexible strap material.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment, in addition to the scope of the invention defined by the claims taken in conjunction with the accompanying drawings.

SUMMARY OF THE INVENTION

The invention is defined by the appended claims with a specific embodiment shown in the attached drawings and explained in the detailed discussion. For the purpose of summarizing the invention, the invention may be incorporated into a reversible protective loop for a flexible strap comprising first means for securing the terminal end of the flexible strap to an adjacent area of the flexible strap creating the loop thereby. Second means secures a fold of the flexible strap within the loop thereby creating a folded region of increased strap thickness and decreased strap width. A protective cover completely encompasses the folded region of the flexible strap. A twist is interposed in the loop enabling alternate sides of the protective cover to be positioned within the loop to alternate the wear on the plural sides of the protective cover.

In a more specific embodiment of the invention, the flexible strap may be a substantially flat nylon strap with the protective cover comprising a plural component material having superior durability characteristics relative to the flexible strap. A combination of nylon and cotton has been found suitable for the protective cover. The terminal end of the strap is sewn to the adjacent area of the strap by nylon thread or the like. In a similar manner, the flexible strap is sewn together by a suitable material such as a nylon thread or the like to create the folded region. The folded region is substantially twice the thickness and one-half the width of an unfolded region of the flexible strap. This configuration increases the strength of the critical contact point where the loop contacts a workpiece or the like. The protective cover is similarly sewn to the folded region of the flexible strap. The protective cover comprises a first portion for overlapping a second portion of the protective cover. The nylon stitches extend through the first and second portions of the protective cover and into the folded region of the flexible strap.

The twist within the loop is preferably a one hundred and eighty degree rotation of the flexible strap within the loop. The twist is disposed adjacent the folded region encompassed by the protective cover. Accordingly, the twist occurs within a region where the flexible strap is only partially folded relative to the folded region.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Figure 1:
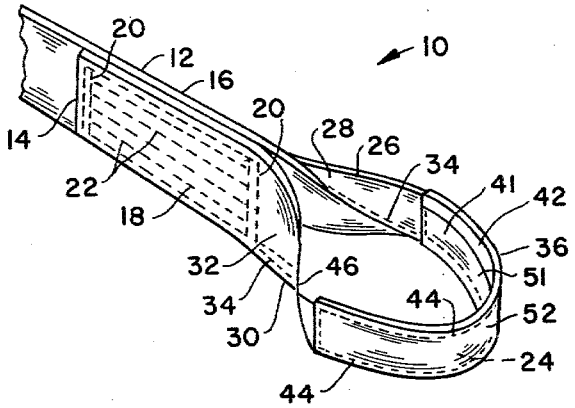
FIG. 1 is an isometric view of an improved reversible protective loop for a flexible strap.
Figure 2:
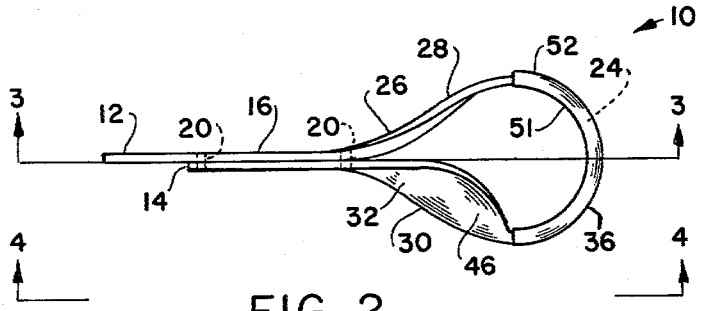
FIG. 2 is a plan view of the loop shown in FIG. 1.
Figure 3:
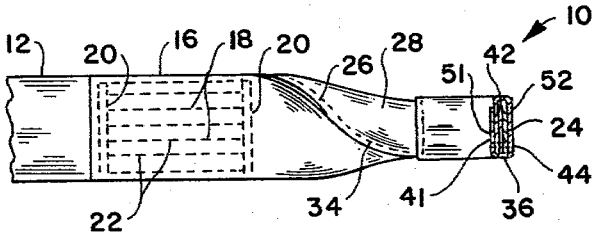
FIG. 3 is a sectional view along line 3—3 of the loop shown in FIG. 2.
Figure 4:
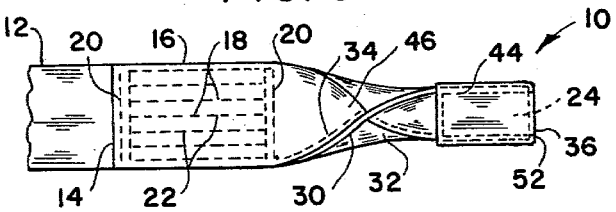
FIG. 4 is an elevational view as seen along line 4—4 of the loop shown in FIG. 2.

Similar reference characters refer to similar parts throughout the several views of the drawings. For a more clearer understanding of the invention, the following number identifications taken in connection with the detailed description and the drawings set forth the preferred mode or practice of the invention.

| | | | |
|---|---|---|---|
| 10 | loop | 30 | gradual fold |
| 12 | flexible strap | 32 | strap portion |
| 14 | terminal end | 34 | threads |
| 16 | adjacent area | 36 | protective cover |
| 18 | threads | 41 | first portion |
| 20 | cross threads | 42 | second portion |
| 22 | longitudinal threads | 44 | thread |
| 24 | folded region | 46 | twist |
| 26 | gradual fold | 51 | side |
| 28 | strap portion | 52 | side |

DETAILED DESCRIPTION

FIGS. 1-5 illustrate various views of the preferred embodiment of the invention showing a loop 10 for a flexible strap 12 such as a flat nylon strap or belt. A terminal end 14 of the flexible strap 12 is disposed against an adjacent area 16 of the terminal end 14 thereby creating the loop 10 therebetween. Threads 18 secure the terminal end 14 to the adjacent area 16 of the flexible strap 12. The threads 18 comprise cross threads 20 and longitudinal threads 22. The terminal end 14 has an identical thickness and strap width as the adjacent area 16. The flexible strap 12 is folded within the loop thereby creating a folded region 24 most clearly shown in FIG. 3. The folded region 24 increases the strap thickness and decreases the strap width. In this embodiment, the thickness of the strap has been doubled and the width of the strap has been reduced to one-half the unfolded strap dimensions. The folded region 24 is created by a gradual fold 26 emanating from the top of strap portion 28 and a gradual fold 30 emanating from the bottom of strap portion 32. The folded region 24 is secured by threads 34 extending along the open end of the folded region between the strap portions 28 and 32. A protective cover 36 preferably made of a durable material such as nylon and cotton, for example sold under the Trademark "CORDURA", completely encompasses the folded region 24 of the flexible strap 12. The protective cover 36 has a first portion 41 which overlaps a second portion 42 enabling threads 44 to extend through the first and second portions 41 and 42 of the protective cover 36 in addition to extending through the folded region 24.

Figure 5:
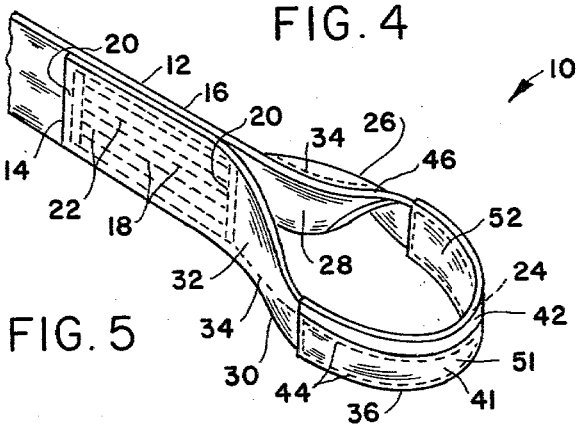
FIG. 5 is an isometric view of the loop shown in FIG. 1 wherein the loop has been twisted thereby exposing an alternate side of the protective cover to face the inside of the loop.

A twist 46 is interposed in the loop enabling alternate sides 51 and 52 of the protective cover 36 to face the inside of the loop. The twist 46 is preferably a one hundred and eighty degree twist which facilitates the alternate use of the first and second sides 51 and 52. FIG. 1 illustrates the first side 51 facing the inside of loop 10 whereas FIG. 5 illustrates the second side 52 facing the inside of loop 10. A one hundred and eighty degree rotation from FIG. 1 to FIG. 5 causes the twist 46 to move from strap portion 32 to strap portion 28. Accordingly, the novel construction as set forth herein enables the major wear which occurs on the internal area of the loop to be equally distributed on alternate sides 51 and 52 of the protective cover 36 by merely twisting the loop 10 prior to engagement with a workpiece (not shown). The twist 46 facilitates the rotation of one hundred and eighty degrees between the alternate sides 51 and 52.

The novel folded region 24 doubles the thickness and reduces the width of the strap which makes the device desirable for use on land vehicle towing tasks incorporating a trailer hitch, ball, or the like. The full protective cover 36 in combination with the twist 46 results in an extended life of the loop 10 over the prior art. The invention has provided a substantial improvement over the prior art loop without raising the material cost over that of the prior art loop.

It should be understood that numerous types of materials may be utilized for the flexible strap and the protective cover, and the invention as hereinafter claimed should not be considered limited by the materials set forth in this disclosure.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention.

Now that the invention has been described:

What is claimed is:

1. A reversible protected loop for a flexible strap, comprising in combination:

first means for securing the terminal end of the flexible strap to an adjacent area of the flexible strap creating the loop thereby;

second means for securing a fold of the flexible strap within the loop thereby creating a folded region of increased strap thickness and decreased strap width;

a protective cover completely encompassing said folded region of the flexible strap; and a twist interposed in the loop enabling alternate sides of said protective cover to be positioned within the loop.

2. A loop as set forth in claim 1, wherein said flexible strap is a substantially flat nylon strap.

3. A loop as set forth in claim 1, wherein said first means includes the terminal end of the strap being sewn to said adjacent area of the strap.

4. A loop as set forth in claim 1, wherein said second means includes the folded components of the flexible strap being sewn together.

5. A loop as set forth in claim 1, wherein said folded region comprises substantially twice the thickness and half the width of an unfolded region of the flexible strap.

6. A loop as set forth in claim 1, including third means for securing said protective cover to said folded region of the flexible strap.

7. A loop as set forth in claim 6, wherein said protected cover comprises a first portion for overlapping a second portion of said protective cover.

8. A loop as set forth in claim 7, wherein said third means includes said first and second portions of said protective cover being sewn to said folded region of the flexible strap.

9. A loop as set forth in claim 8, wherein said protective cover comprises a plural component material having superior durability characteristics relative to the flexible strap.

10. A loop as set forth in claim 1, wherein said twist comprises a one hundred and eighty degree rotation of the flexible strap within said loop.

11. A loop as set forth in claim 10, wherein said twist is disposed adjacent said folded region encompassed by said protective cover.

* * * * *